United States Patent [19]

Schultz

[11] 4,073,398

[45] Feb. 14, 1978

[54] SNAP-LOCK DEVICE FOR SECURING A DISPENSING MECHANISM TO A CONTAINER

[75] Inventor: Robert S. Schultz, Old Greenwich, Conn.

[73] Assignee: The Risdon Manufacturing Company, Naugatuck, Conn.

[21] Appl. No.: 763,568

[22] Filed: Jan. 28, 1977

[51] Int. Cl.[2] ..... B65D 41/32

[52] U.S. Cl. ..... 215/253; 215/272; 215/274

[58] Field of Search ..... 215/250, 253, 272, 274; 222/402.1, 402.21, 402.22, 402.24; 220/67, 85 P

[56] References Cited

U.S. PATENT DOCUMENTS

| | | | |
|---|---|---|---|
| 681,774 | 9/1901 | Bailey | 215/250 |
| 3,586,196 | 6/1971 | Barton | 215/250 |
| 3,905,502 | 9/1975 | Wassilieff | 215/272 |

FOREIGN PATENT DOCUMENTS

| | | | |
|---|---|---|---|
| 2,307,715 | 9/1973 | Germany | 215/272 |
| 549,372 | 10/1956 | Italy | 215/272 |
| 1,442,433 | 7/1976 | United Kingdom | 215/272 |

*Primary Examiner*—Ro E. Hart

*Attorney, Agent, or Firm*—St. Onge, Mayers, Steward & Reens

[57] ABSTRACT

A snap-lock device, for securing a dispensing mechanism to the mouth of a container which has an annular bead about the mouth periphery, comprises a bead embracing ring having an axially extending annular recess open at one end of its axial extent to receive the bead. An annular rib, formed with the ring adjacent the open margin of the recess, underlies at least a portion of the bead to prevent axial bead-ring disengagement. A retainer element, engageable on the ring when installed on the bead, exerts a radial force against the ring and holds the rib in underlying relation to the bead. The dispensing mechanism is mounted with one of the ring and element. A rabbeted interlocking arrangement between the ring and element prevents their relative disengagement so that the dispensing mechanism cannot be removed from the container. Therefore, the device can be used with pressurized barrier-type and aerosol containers.

9 Claims, 7 Drawing Figures

Fig. 1.
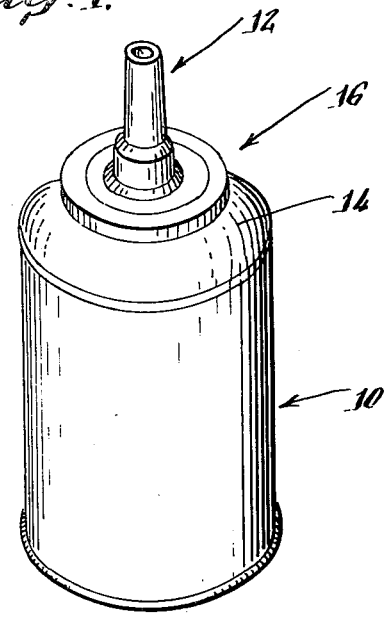
Fig. 2.
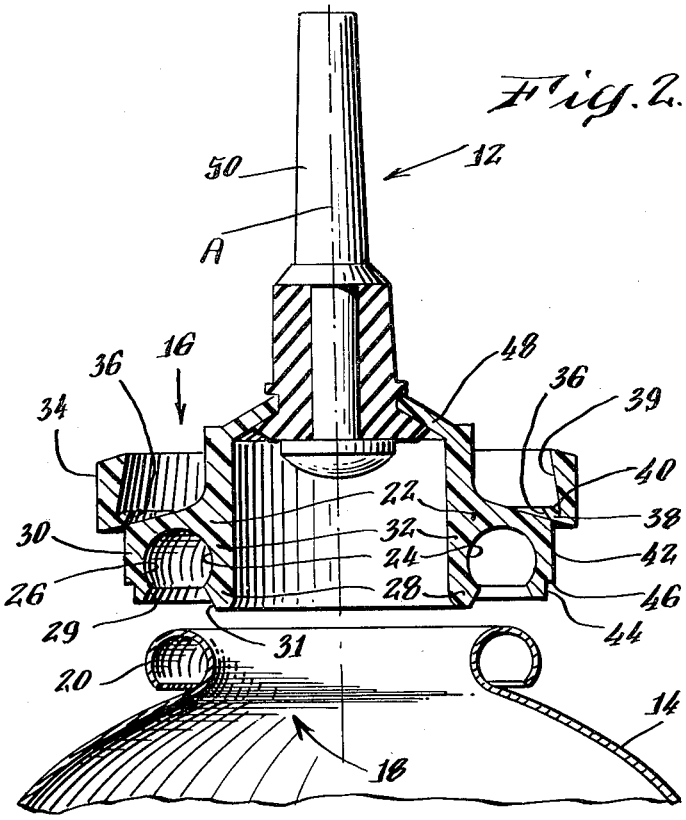
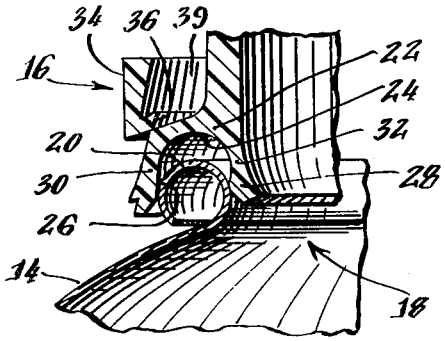
Fig. 3.
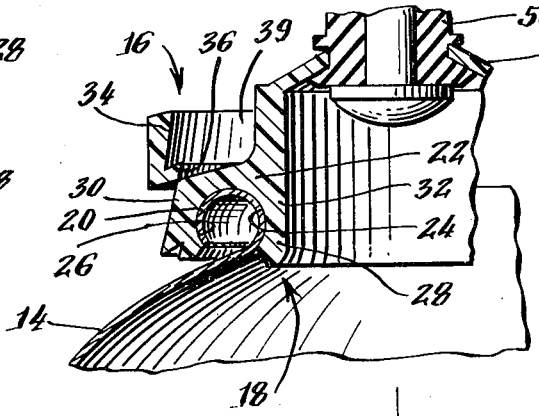
Fig. 4.
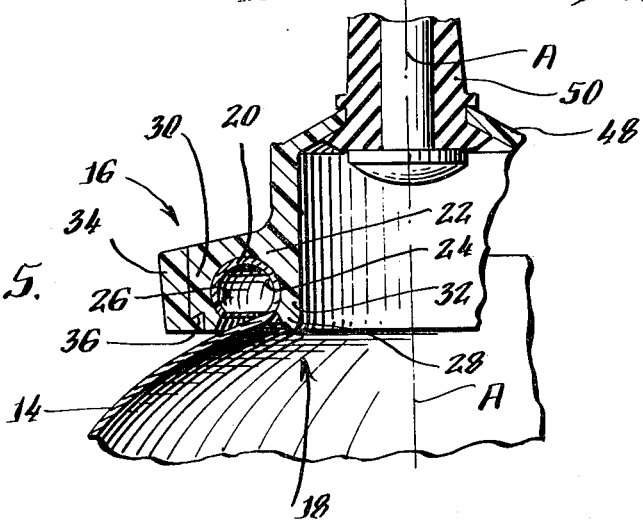
Fig. 5.

SNAP-LOCK DEVICE FOR SECURING A DISPENSING MECHANISM TO A CONTAINER

BACKGROUND OF THE INVENTION

1. Field of the Invention

The present invention relates to a snap-lock device for securing a dispensing mechanism to the mouth of a container having an annular bead about the mouth periphery. The device is specifically designed for mounting one of many types of aerosol valves on a pressurized barrier or aerosol container but may also be adapted for mounting a mechanism such as a pump on a non-pressurized container. A barrier-type package is one having a pressure charge for expelling a product from a container which is separated from the product by a barrier such as a movable piston or collapsible bag. These containers are commonly used to dispense viscous products as diverse as caulking compounds, toothpaste and foods. An aerosol package is generally considered to be one in which the product and a liquid propellant are mixed, the vapor phase of the propellant providing the internal pressure in the container.

Conventional pressurized containers of both types mentioned above, with which the snap-lock device of the invention may be used, are made of metal and have an inverted hemispherical top which defines an open mouth. The top is rolled or otherwise shaped at the mouth to form an annular bead which has a generally circular cross-section. This bead provides a base to which conventional dispensing mechanisms such as valves are attached.

2. Description of the Prior Art

Various devices for securing a dispensing mechanism to the bead formed about the periphery of an aerosol container mouth are known. Perhaps the most common is a metal valve cup having a recessed center web for supporting an aerosol valve, a cylindrical section extending upwardly from the web and a rolled clamping ferrule at the top of the cylindrical section. The ferrule is usually provided with a heavy, resilient sealant and is then crimped to the container mouth bead to form a seal which is pressure-tight within the range of pressures for which the container is designed. However, this arrangement has certain drawbacks. The machinery for forming, installing, and crimping the valve cup is relatively complex. Moreover, since a sealant is applied to the cup, at least one additional step is introduced into the container assembly process. Many common heavy sealants are applied and then baked on the ferrule for an extended period thus requiring two added steps.

Various container closure devices are also known. For example, U.S. Pat. No. 2,814,405 (Edwards) discloses a reusable closure for a container such as a bottle, that includes a cylindrical cap, closed at one end, that encircles the neck of the bottle about the bottle mouth. A removable ring is adapted to crimp the cap against the bottle neck. However, the Edwards device is unsuitable for securing a dispensing device to a pressurized container because, in all of its embodiments, it is removable and, therefore, would not reliably contain the pressure charge. Moreover, any pressure developed in the bottle would tend to dislodge the closure. Such pressure would not aid in sealing the closure.

Other devices having components telescopically received in other components are disclosed in U.S. Pat. Nos. 3,159,318 (Green) and 3,470,893 (Nelson).

SUMMARY OF THE INVENTION

In a preferred embodiment, to be described below in detail, the snap-lock device of the present invention secures a dispensing mechanism, such as a pump, valve, or the like, to the mouth of a container which has an annular bead about the mouth periphery. The snap-lock device may be used with particular advantage to secure an aerosol dispensing valve to a pressurized barrier-type container since once installed, it cannot be easily removed and further remains pressure tight. In addition, the snap-lock device may be integrally formed with one of many valve configurations in order to achieve substantial production economies.

When used in conjunction with a viscous product container, the device may secure the dispensing mechanism thereto without a special sealant. When used in conjunction with an aerosol container, a light sealant between the device and the container may be used.

In its preferred form, the snap-lock device comprises a bead embracing ring having an axially extending annular recess open at one extreme of its axial extent in order to receive the bead. The recess is shaped so that the ring can tightly embrace the bead. An annular rib, adjacent the open margin of the recess, underlies at least a portion of the bead when received in the recess.

A retainer in the form of a lock element is engagable with the ring to exert radial force against the ring and retain the rib in underlying relation to the bead. The dispensing mechanism is mounted with either the ring or the lock element.

A rabbet arrangement is provided on the ring and lock element to positively prevent their relative disengagement, which would otherwise be caused by internal container pressure, once the snap-lock mechanism is installed on the container. This arrangement includes a first rabbet having a flange surface that faces axially inwardly of the container and is formed on the ring. A second rabbet, shaped to mate in interlocking engagement with the first, has a flange surface facing axially outwardly of the container and is formed on the lock element. Thus, when the lock element is engaged on the ring, the respective rabbets are interlocked. The respective rabbet flanges are faced so that the lock element may not be forced axially outwardly of the ring under the influence of internal container pressure, an accidental impact or other cause. The configuration of the bead embracing ring and the lock element make the device pressure tight.

Accordingly, it is an object of the present invention to provide a snap-lock device for securing a dispensing mechanism to the mouth of a container and particularly for securing such a mechanism to the mouth of a pressurized container. When used in conjunction with an integrally formed dispensing mechanism, this snap-lock device achieves substantial economies of both formation of the dispensing mechanism and assembly with the container.

Other objects, aspects, and advantages of the present invention will be pointed out in or will be understood from the following detailed description provided below in conjunction with the accompanying drawings.

BRIEF DESCRIPTION OF THE DRAWINGS

FIG. 1 is a perspective view of an aerosol container equipped with a dispensing mechanism secured thereto by the snap-lock device of the present invention.

FIG. 2 is a vertical cross-sectional view of the dispensing mechanism and snap-lock device prior to final installation on the container.

FIG. 3 is a partial vertical cross-sectional view similar to that shown in FIG. 2 particularly illustrating the ring of the snap-lock device as it is snapped on the container bead.

FIG. 4 is a partial vertical cross-sectional view illustrating the snap-lock device after it has been snapped on the container bead.

FIG. 5 is a partial vertical cross-sectional view of the snap-lock device with the lock element secured to the bead embracing ring.

DETAILED DESCRIPTION OF THE PREFERRED EMBODIMENTS

Figure 6:
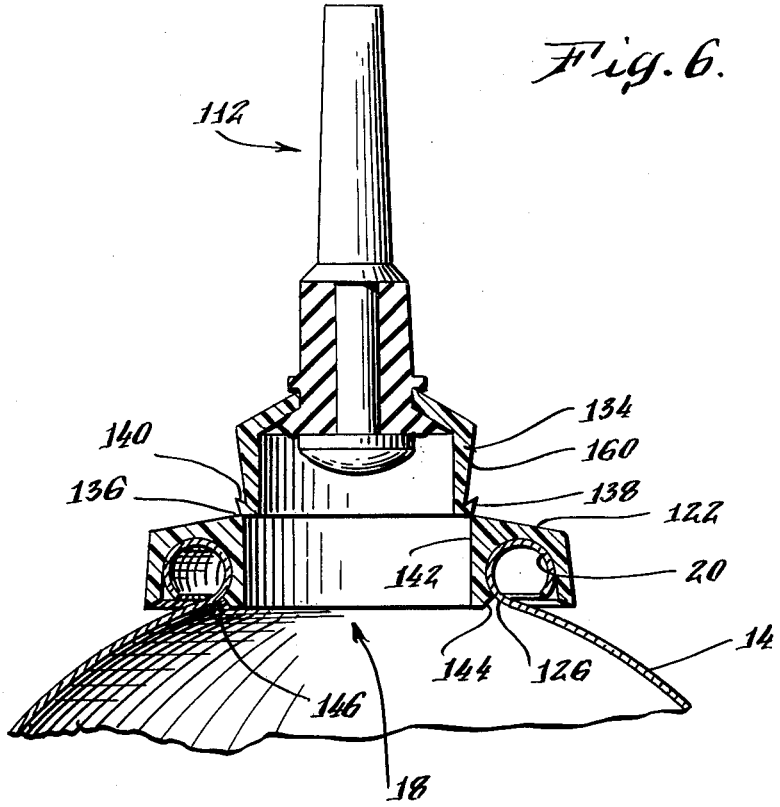
FIG. 6 is a vertical cross-sectional view of a second embodiment of the snap-lock device of the present invention prior to permanent installation on a container.

FIG. 1 illustrates a typical barrier-type container, generally indicated at 10, equipped with a dispensing device, in the form of a tilt-type dispenser valve generally indicated at 12, attached to and extending axially upwardly from the upper end 14 of the container. (Since the barrier related components of the container form no part of the present invention they are not illustrated.) The valve 12 is secured to the container by a snap-lock device, generally indicated at 16, constructed in accordance with one preferred embodiment of the present invention. This snap-lock device, which will be described below in detail, may also be used to secure other dispensing devices such as pumps to conventional containers. However, the design of the snap-lock device makes it particularly well adapted for securing valves to pressurized containers since it is capable of achieving special economies in such applications. In particular, the snap-lock device is constructed in such a manner that it (1) holds the valve on the container under pressure, (2) will hold viscous product under pressure without sealant, and (3) may hold aerosol products (vapor pressurized products) without a sealant, but if one is necessary, it may be a low cost, air dried spray-type sealant.

As can be seen in FIG. 2, the upper end 14 of the container has a semi-spherical shape which is open to form a mouth 18 having a rolled bead 20 about its periphery. Ordinarily, this top as well as the remainder of the container is made of metal. However, it may be made from any other suitable material such as plastic or extruded aluminum.

This configuration is typical of steel containers. Extruded aluminum containers have a closed bead with a cross-sectional shape more rectangular than that of the rolled bead illustrated. In either case, however, annular lips are formed on the inside and outside of the bead.

The snap-lock device 16 comprises a bead embracing ring 22 which may be made from plastic using conventional up-down injection molding techniques. The ring 22 is formed with an annular recess 24 which extends in the direction of the container and valve axis A and is shaped so that the ring closely conforms to the bead when installed thereon as shown in FIGS. 4 and 5. The recess 24 may further be shaped so that the ring embraces more than 180° of the circular cross-sectional shape of the bead as illustrated. When the cross-sectional shape is not circular, the recess may be shaped so that the ring conforms to a large portion of the bead surface and preferably at least half of the cross-sectional bead shape. The ring configuration, then, includes an annular rib 26 which underlies the bead 20 at a location outside of the container and is locked in place in a manner to be described below. A second annular rib 28 may be provided to underlie the bead 20 at a location inside of the container. Therefore, internal pressure in the container tends to force the second rib 28 into further tight engagement with the bead.

Both annular ribs 26 and 28 are joined to the remainder of the bead embracing ring 22 by thin walled sections 30 and 32 respectively. Further, both ribs 26 and 28 have beveled lower margins 29 and 31 respectively. Therefore, as can be seen in FIG. 4, the ring may be installed on the bead by downward axial pressure camming or snapping the respective annular ribs 26 and 28 thereover since the sections 30 and 32 are flexible.

Once the ring 22 is installed on the bead, it may be permanently held thereon by a retainer in the form of a cylindrical locking element or collar 34. As shown in FIGS. 2, 3, and 4, the collar 34 is initially formed with and joined to the bead embracing ring 24 during the molding process by a thin, frangible web 36 at a position axially displaced from its final position shown in FIG. 5. On its inner cylindrical wall 39, the collar has an annular rabbet 38 having a flange surface 40 that faces outwardly of the container. Similarly, the bead embracing ring, which has an outer cylindrical side wall 42, is formed with a mating annular rabbet 44 having an axially inwardly facing flange surface 46. The respective flange surfaces extend in a generally radial direction and may be slightly conical to insure positive interlocking as will be described.

Further, as shown in FIG. 2 prior to permanent installation, the outside diameter of the outer wall 42 of the ring 22 is substantially equal to a major portion of the inside diameter of the inner wall 39 of the collar. However, the recess is dimensioned so that after the ring is snapped downwardly over the bead, outer wall 42 expands in the radial direction into an exaggerated cone so that its outside diameter is larger than the inside diameter of the ring (see FIG. 4).

Installation of the ring on the bead is made permanent by axially forcing the collar 34 downwardly to break the web 36. When the respective rabbets are interengaged as shown in FIG. 5, the collar 34 exerts a substantial force in the radial direction against the outer cylindrical wall 42 of the ring and thereby retains the annular rib 26 in underlying relation to the bead 20. The radial force is enhanced by the dimensional relationship described above. That is, the collar must be force fitted down over the ring because of the radial ring expansion. Therefore, the collar is stretched slightly in the radial direction. However, the natural resilience of the collar tends to resist this stretching and radially compress the ring to form a pressure tight seal.

The positive interlock between the respective rabbeted flanges on the collar 34 and ring 22 prevents relative disengagement of the two. Moreover, the radial force exerted by the collar on the ring to hold the rib in underlying relation to the bead positively prevents disengagement of the ring from the container. Accordingly, this snap-lock has particular application for pressurized containers since they may be easily made pressure tight. By using up and down molding techniques, the bead accepting recess 24 may be made without mold parting lines. Moreover, the plastic material from which the ring is molded may be made extremely smooth. And since the recess closely conforms to and contacts a large portion of the cross-section of the bead, a firm, positive seal is made between the bead and the ring.

More economies may be achieved with the snap-lock device of the present invention by integrally molding at least a portion of the dispensing device with it. Accordingly, as shown in FIGS. 2, 4, and 5, the bead embracing ring 22 may be formed with an upper conically shaped housing 48 which accepts a valve element 50, for example, of the tilt-action type. This valve is similar to that shown in U.S. Pat. No. 3,926,349 (Schultz). Of course, other valve configurations may be adapted for installation through the snap-lock device of the present invention. The configuration of the upper housing 48 need only be changed to accommodate the desired configurations.

Figure 7:
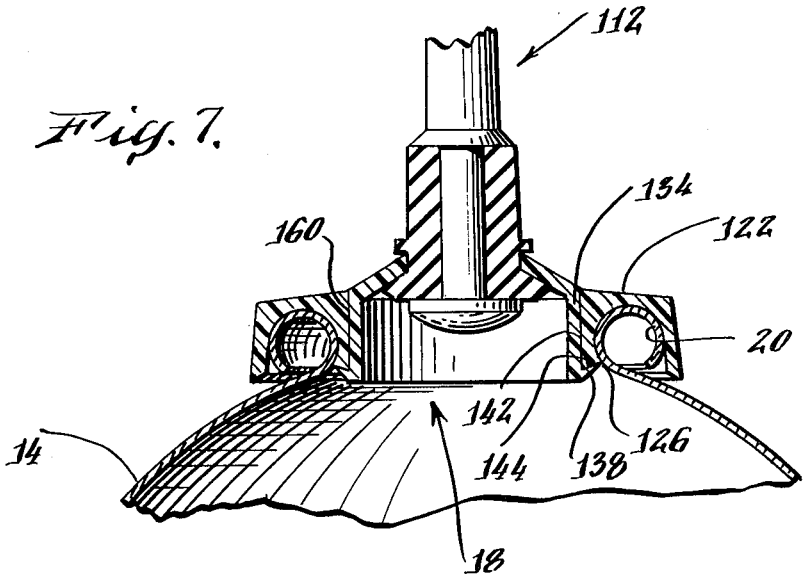
FIG. 7 is a vertical cross-sectional view similar to that shown in FIG. 5 illustrating the second embodiment after permanent installation.

A second embodiment of the snap-lock device of the present invention is illustrated in FIGS. 6 and 7. In this embodiment, the bead embracing ring 122 is molded at an radially outward position relative to the locking collar 134. The dispensing device, for example, the tilt-action aerosol valve 112, is mounted with the collar 134. Thus, the collar 134 is adapted to snap to a position inside the ring 122 instead of outside thereof as is the case with the first embodiment. That is, the ring 122 is formed with an inner cylindrical wall 142 having a rabbet 144 that has an axially inwardly facing flange surface 146. Similarly, the collar 134 has a radially outwardly facing cylindrical wall 160 formed with an annular rabbet 138 having an axially outwardly facing flange surface 140. Again, the recess 124 is formed so that the ring 122 tightly embraces the bead 120. Moreover, an annular rib 126 is formed at the lower margin of this recess to underlie the bead.

The collar is initially molded with and interconnected to the ring by a thin frangible web 136. Axially inwardly applied pressure on the collar breaks the web to drive the collar axially inwardly until the respective rabbets on the ring and collar are interengaged as shown in FIG. 7. In this case, a radially outwardly directed force is exerted on the ring to retain the annular rib 126 in underlying relation to the bead. Interlocking engagement of the respective rabbets prevents disengagement of the collar and rib. Furthermore, as with the first embodiment, the recess is dimensioned so that the inner wall 142 of the ring 122 expands slightly in the radialy direction when the ring is installed on the bead. Though the diameters of walls 142 and 160 are initially equal, the diameter of wall 142 decreases slightly when the ring is so installed to establish a force fit between the collar and ring that insures pressure tight assembly.

The second embodiment of the present invention may be used in applications where the radial dimension of the snap-lock device is desirably kept to a minimum. However, where such dimensions are not of concern, either embodiment may be used. Both embodiments are adapted for high pressure barrier-type and aerosol container applications. In the first, the locking collar 34 can exert a large inward radial force. In the second, internal pressure tends to force the locking collar 134 radially outwardly to further retain the bead embracing ring 122 in firm engagement with the bead.

It can be seen that the snap-lock device of the present invention provides a convenient means for attaching a dispensing device to a container and particularly for attaching an aerosol valve to a pressurized aerosol container. Economies may be achieved in the unitary molding of the device and the dispensing mechanism as well as in the elimination of special sealing components ordinarily required in attaching a dispensing mechanism to the container.

Although specific embodiments of the present invention have been described above in detail, it is to be understood that this is for purposes of illustration. Modifications may be made to the described snap-lock devices by those skilled in the art in order to adapt these devices to particular applications for securing dispensing mechanisms to conventional containers.

What is claimed is:

1. A snap-lock device for securing a dispensing mechanism, such as a pump, valve, or the like, to the mouth of a container which has an annular bead about the mouth periphery; said snap-lock device comprising:

A. a bead embracing ring formed with
   1. an axially extending, annular recess which is open at one extreme of its axial extent to receive the bead, said recess being shaped so that said ring tightly embraces the bead when received in said recess; and
   2. an annular rib, adjacent the open margin of said recess, which underlies at least a portion of the bead when received in the recess;

B. retainer means, engagable on said ring when installed on the bead, for exerting a force against said ring in the radial direction to retain said rib in underlying relation to the bead, the dispensing mechanism being mounted with one of said ring and retaining means; and C. means for positively preventing relative disengagement of said ring and retaining means.

2. The snap-lock device for securing a dispensing mechanism to the mouth of a container as claimed in claim 1 wherein retainer means comprises:

an annular lock element formed to radially engage said ring to exert a radial force thereagainst and retain said rib in underlying relation to the bead.

3. The snap-lock device for securing a dispensing mechanism to the mouth of a container as claimed in claim 2 wherein said preventing means comprises:

1. a first rabbet, having a flange surface facing axially inwardly of the container, formed on said ring; and
2. a second rabbet, shaped to mate in interlocking engagement with said first rabbet, having a flange surface facing axially outwardly of the container, formed on said lock element.

4. The snap-lock device for securing a dispensing mechanism to the mouth of a container as claimed in claim 2 wherein said lock element is initially interconnected to said ring by a frangible web in a position axially displaced from its position engaged on said ring, said lock element being engagable on said ring by applying an axial force to said element to break said web.

5. The snap-lock device for securing a dispensing mechanism to the mouth of a container as claimed in claim 1 wherein said annular recess is shaped so that said ring embraces at least half of the cross-sectional shape of the bead.

6. The snap-lock device for securing a dispensing mechanism to the mouth of a container as claimed in claim 1 wherein said bead embracing ring further comprises:

an annular wall portion interconnecting said rib with the remainder of said ring, said wall portion being flexible to permit said rib to be radially displaced during installation on the container bead.

7. The snap-lock device for securing a dispensing mechanism to the mouth of a container as claimed in claim 1 wherein said ring is formed with a beveled cross-section at the margin of said recess to effect a radial camming action thereof when said ring is engaged on the bead.

8. The snap-lock device for securing a dispensing mechanism to the mouth of a container as claimed in claim 1 wherein at least a portion of the dispensing mechanism is integrally formed with one of said ring and retainer means.

9. The snap-lock device for securing a dispensing mechanism to the mouth of a container as claimed in claim 1 wherein the diameters of said ring and said locking elements are substantially equal prior to installation on the container and wherein the diameter of said ring changes when installed on the bead to establish a force fit between the ring and locking element when the two are interengaged.

* * * * *